US008601746B1

(12) United States Patent
Karaim

(10) Patent No.: US 8,601,746 B1
(45) Date of Patent: Dec. 10, 2013

(54) ROOF BRACKET ASSEMBLY

(76) Inventor: John Karaim, Maple Valley, WA (US)

( * ) Notice: Subject to any disclaimer, the term of this patent is extended or adjusted under 35 U.S.C. 154(b) by 0 days.

(21) Appl. No.: 13/598,067

(22) Filed: Aug. 29, 2012

(51) Int. Cl.
*E04B 7/00* (2006.01)
*E04C 5/01* (2006.01)

(52) U.S. Cl.
USPC ..... 52/92.2; 52/715

(58) Field of Classification Search
USPC ..... 52/92.2, 511, 715, 712, 93.1
See application file for complete search history.

(56) References Cited

U.S. PATENT DOCUMENTS

| | | | | |
|---|---|---|---|---|
| D65,492 | S | 8/1921 | Pourmon | |
| 2,752,645 | A | 7/1956 | Mann et al. | |
| D209,085 | S | 10/1967 | Margolis | |
| 4,340,100 | A | 7/1982 | Anderson | |
| 5,181,683 | A * | 1/1993 | Smith | 248/231.31 |
| 5,524,397 | A * | 6/1996 | Byers et al. | 52/92.2 |
| 6,240,702 | B1 * | 6/2001 | Wilson | 52/749.1 |
| 6,470,632 | B1 * | 10/2002 | Smith | 52/92.2 |
| 6,758,016 | B2 * | 7/2004 | Gobeil | 52/191 |
| 7,024,825 | B2 * | 4/2006 | Kebeli | 52/93.1 |
| 7,631,463 | B2 * | 12/2009 | Greenlee et al. | 52/182 |
| 7,861,990 | B2 | 1/2011 | Barnes | |
| 8,387,333 | B2 * | 3/2013 | Brekke | 52/702 |
| 8,484,927 | B2 * | 7/2013 | Nguyen | 52/714 |
| 2005/0017142 | A1 | 1/2005 | Ogden | |
| 2006/0080899 | A1 | 4/2006 | Wilson | |
| 2008/0016791 | A1 * | 1/2008 | Walker | 52/92.2 |
| 2011/0278410 | A1 * | 11/2011 | Mai | 248/237 |
| 2012/0079786 | A1 * | 4/2012 | O'Donnell | 52/698 |

* cited by examiner

*Primary Examiner* — Christine T Cajilig

(57) ABSTRACT

A roof bracket assembly includes a bracket that may be coupled to a roof. A free end of the bracket may be coupled to a support member. The bracket may prevent the support member from penetrating the roof.

8 Claims, 4 Drawing Sheets

ROOF BRACKET ASSEMBLY

BACKGROUND OF THE DISCLOSURE

Field of the Disclosure

The disclosure relates to roof bracket devices and more particularly pertains to a new roof bracket device for coupling a support member to a roof.

SUMMARY OF THE DISCLOSURE

A bracket is provided that may be coupled to a roof. A free end of the bracket may be coupled to a support member. The bracket may prevent the support member from penetrating the roof.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
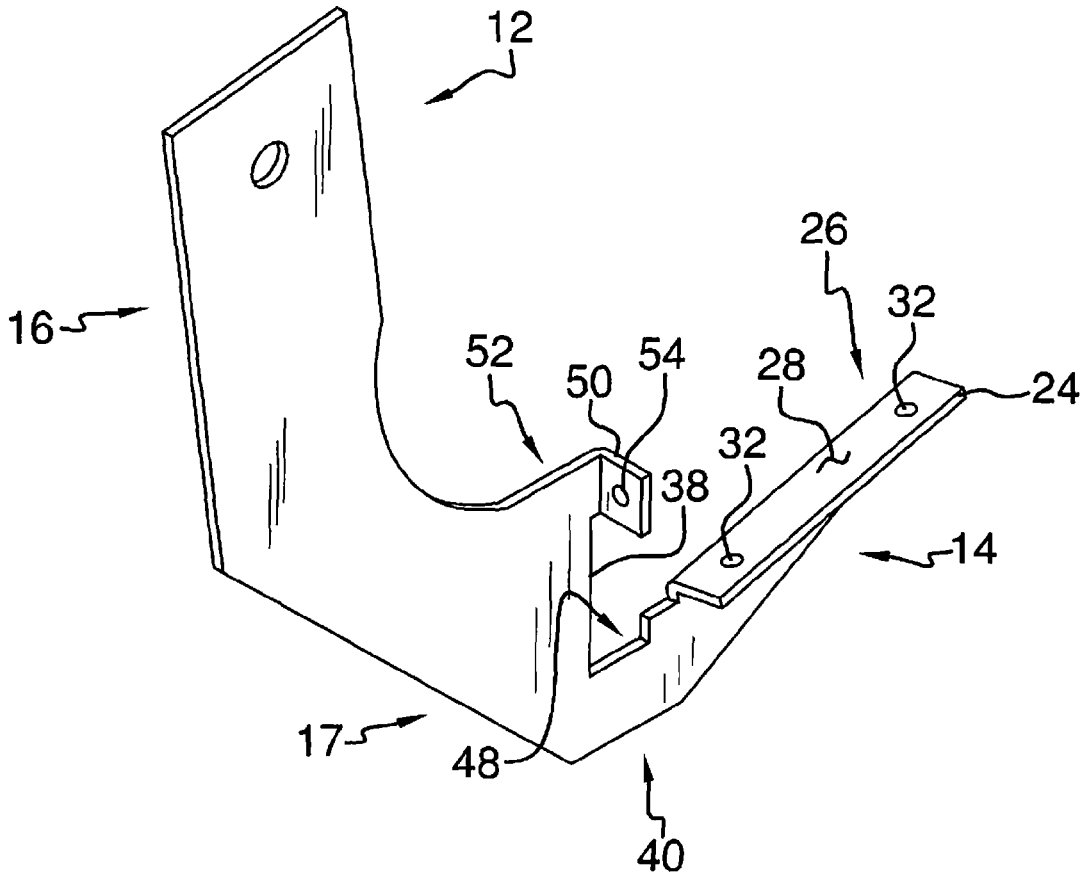
FIG. 1 is a perspective view of a roof bracket assembly according to an embodiment of the disclosure.
Figure 2:
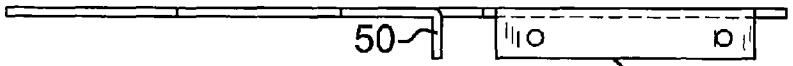
FIG. 2 is a top view of an embodiment of the disclosure.
Figure 4:
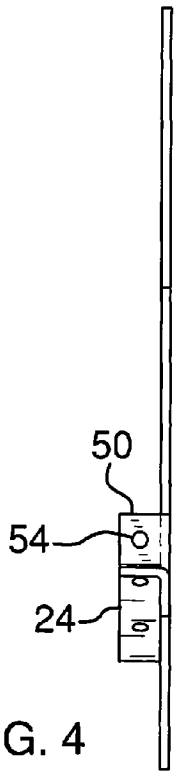
FIG. 4 is a front view of an embodiment of the disclosure.
Figure 3:
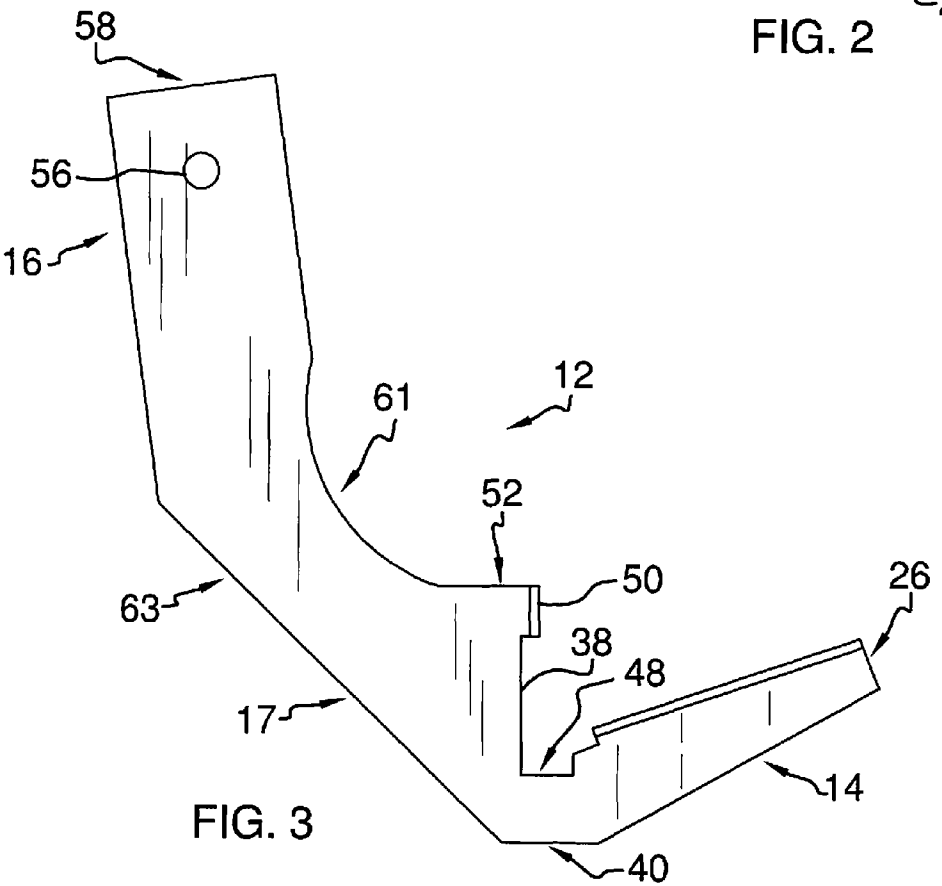
FIG. 3 is a right side view of an embodiment of the disclosure.
Figure 5:
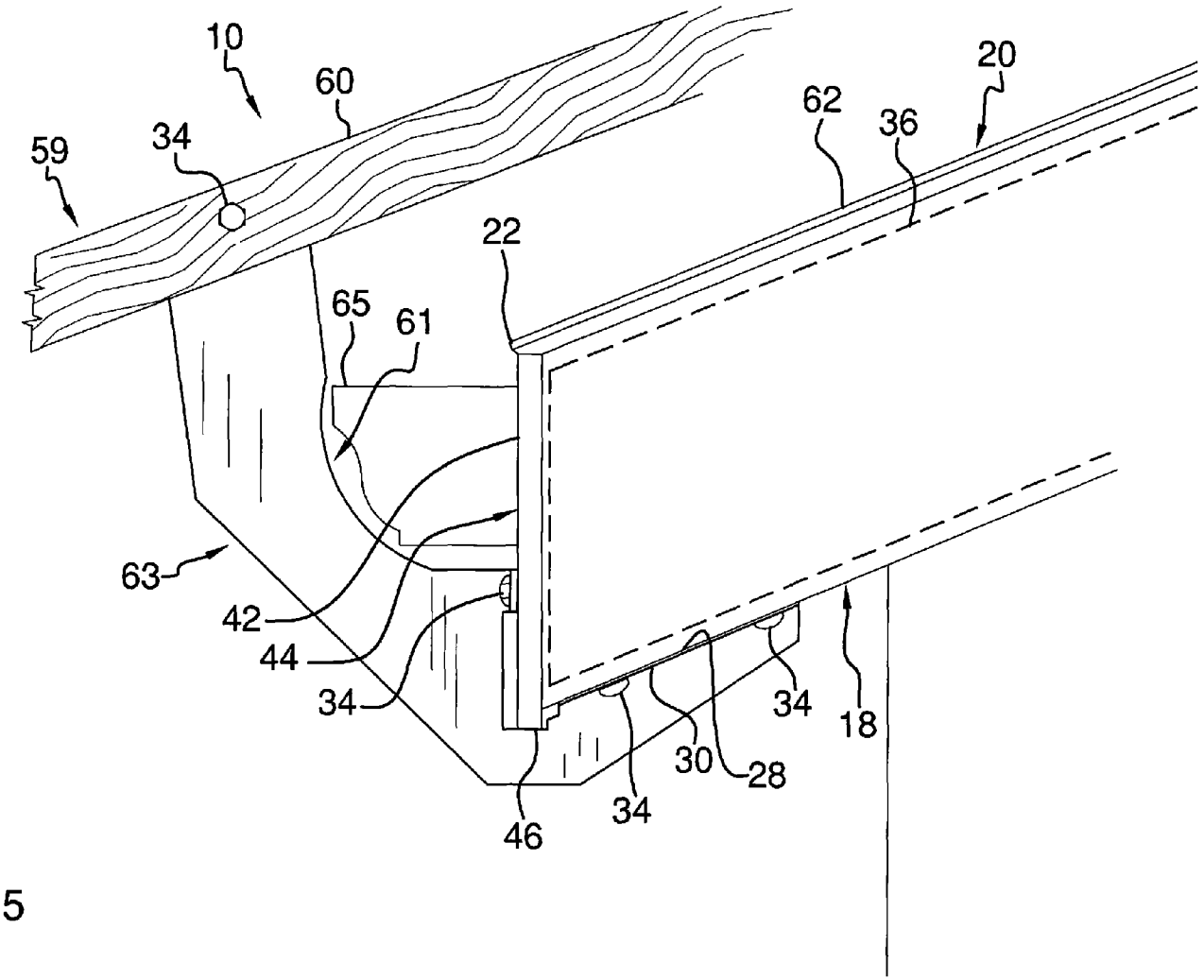
FIG. 5 is an in-use view of an embodiment of the disclosure.
Figure 6:
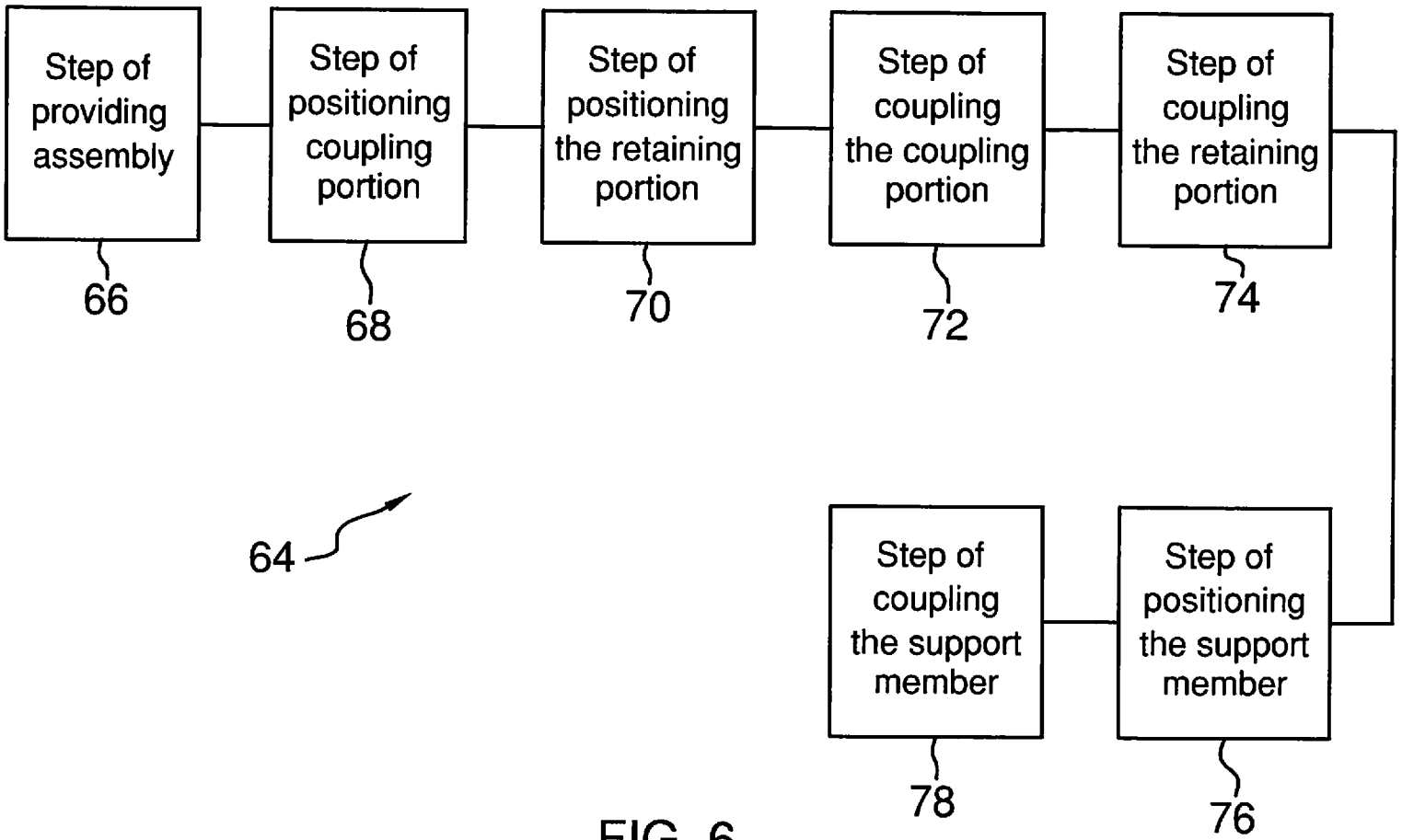
FIG. 6 is a schematic view of a method of utilizing an embodiment of the disclosure.

With reference now to the drawings, and in particular to FIGS. 1 through 6 thereof, a new roof bracket device embodying the principles and concepts of an embodiment of the disclosure and generally designated by the reference numeral 10 will be described.

As best illustrated in FIGS. 1 through 6, the roof bracket assembly 10 generally comprises a bracket 12 that has a coupling portion 14, a support portion 16 and a retaining portion 17. The coupling portion 14 of the bracket 12 is positionable proximate a soffit 18 of a roof 20 such that the support portion 16 extends upwardly from an eave 22 of the roof 20. The coupling portion 14 of the bracket 12 may form a right angle with respect to the support portion 16 of the bracket 12. The coupling portion 14 of the bracket 12 may have a length between 30 cm and 60 cm. The bracket 12 is one of a plurality of brackets 12. The plurality of the brackets 12 may be evenly spaced along a selected length of the eave 22 of the roof 20.

A lip 24 extends laterally away from a top 26 of the coupling portion 14 of the bracket 12. The lip 24 is positionable proximate the soffit 18 of the roof 22 such that a top surface 28 of the lip 24 abuts a bottom surface 30 of the soffit 18. A pair of fastener apertures 32 extends through the lip 24 A pair of fasteners 34 may be extended through each of the fastener apertures 32 in the lip 24 to engage the soffit 18. The fasteners 34 may couple the coupling portion 14 of the bracket 12 to the soffit 18. The lip 24 may be aligned with a roof truss 36 so the fasteners 34 may engage the roof truss 36.

The retaining portion 17 is positioned between the coupling portion 14 and the support portion 16. A front edge 38 of the retaining portion 17 extends upwardly at a right angle from an inner end 40 of the coupling portion 14. The front edge 38 of the retaining portion 17 may abut a front side 42 of a facia 44 on the roof 20 when the lip 24 is positioned proximate the soffit 18. A bottom edge 46 of the facia 44 may be positioned within a groove 48 extending downwardly into the top 26 of the coupling portion 14 of the bracket 12. The groove 48 is positioned proximate the front edge 38 of the retaining portion 17 of the bracket 12.

A tab 50 extends laterally away from the retaining portion 17 of each of the brackets 12 proximate the front edge 38 of the retaining portion 17. The tab 50 may be positioned proximate a top 52 of said retaining portion 17. A fastener aperture 54 extends through the tab 50. A fastener 34 may be extended through the fastener aperture 54 in the tab 50 to engage the facia 44. The fastener 34 may couple the retaining portion 17 to the facia 44.

A fastener aperture 56 extends through a top end 58 of the support portion 16 of the bracket 12. The support portion 16 may have a length between 30 cm and 60 cm. A front side 61 of the support portion 16 may curve toward a back side 63 of the support portion 16. The curved front side 61 of the support portion 16 may prevent the bracket 12 from frictionally engaging a gutter 65 coupled to the eave 22 of the roof 20.

A fastener 34 may be extended through the fastener aperture 56 in the support portion 16 to engage an end 59 of the support member 60. The support member 60 may be coupled to and retained on the support portion 16 after the coupling portion 14 is coupled to the soffit 18 in order for the support member 60 to be coupled to the roof 20. The bracket 12 may eliminate a need to penetrate an upper surface 62 of the roof 20 in order to retrofit the support member 60 to the roof 20.

In use, a method 64 of retrofitting the support member 60 to the roof 20 includes the step of providing 66 a plurality of brackets 12 and a plurality of support members 60. Each of the brackets 12 comprises a coupling portion 14, a support portion 16 and a retaining portion 17. Each of the brackets 12 may be coupled to and evenly spaced along a selected length of the eave 22 of the roof 20. The method 64 also includes the step of positioning 68 the coupling portion 14 of each of the brackets 12 proximate the soffit 18 of the roof 20 such that the support portion 16 of each of the brackets 12 extends upwardly from the eave 22 of the roof 20.

The method 64 further includes the step of positioning 70 the retaining portion 17 of each of the brackets 12 such that the front edge 38 of the retaining portion 17 abuts the front side 42 of the facia 44 on the roof 20. The method 64 additionally includes the step of coupling 72 the coupling portion 14 of each of the brackets 12 to the soffit 18. The method 64 includes the step of coupling 74 the retaining portion 17 of each of the brackets 12 to the facia 44. In addition, the method 64 includes the step of positioning 76 the end 59 of each of the support members 60 proximate the support portion 16 of each of the brackets 12. Finally, the method 64 includes the step of coupling 78 the end 59 of each of the support members 60 to the support portion 16 of each of the brackets 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A roof bracket assembly comprising:

a bracket configured to be coupled to a roof, said bracket comprising a coupling portion, a retaining portion, and a support portion, said support portion being spaced from said coupling portion;

a groove extending downwardly into a top of said coupling portion, said groove being configured for receiving a bottom edge of a fascia on said roof, a first end of said groove being coupled to said retaining portion;

a free end of said bracket configured to be coupled to a support member, wherein said bracket is configured to prevent said support member from penetrating said roof;

a lip configured for positioning proximate a soffit of said roof;

said retaining portion of said bracket being positioned between said coupling portion and said support portion, a front edge of said retaining portion extending upwardly at a right angle from an inner end of said coupling portion, wherein said front edge of said retaining portion is configured to abut a front side of the facia on said roof when said lip is positioned proximate said soffit;

a tab extending laterally away from said retaining portion proximate said front edge of said retaining portion;

a fastener aperture extending through said tab; and a fastener extending through said fastener aperture in said tab and being configured to engage the facia, wherein said retaining portion is configured to be coupled to the facia.

2. The assembly according to claim 1, further comprising said coupling portion of said bracket being positionable proximate a soffit of said roof such that said support portion extends upwardly from an eave of said roof.

3. The assembly according to claim 1, further comprising:

a lip extending laterally away from a top of said coupling portion of said bracket, said lip being configured for positioning proximate a soffit of the roof such that a top surface of said lip abuts a bottom surface of the soffit;

a pair of fastener apertures extending through said lip; and a pair of fasteners extending through said each of said fastener apertures in said lip and being configured to engage the soffit, wherein said coupling portion is configured to be coupled to the soffit.

4. The assembly according to claim 1, further comprising:

said coupling portion being configured for coupling to a soffit on said roof;

a fastener aperture extending through a top end of said support portion; and a fastener extending through said fastener aperture in said support portion and being configured to engage a support member after said coupling portion is coupled to said soffit, wherein said support member is configured to be coupled to and retained on said support portion, wherein said support member is configured to be coupled to said roof.

5. The assembly according to claim 1, further comprising said bracket being one of a plurality of brackets, said plurality of said brackets being configured for being evenly spaced along a selected length of an eave of said roof.

6. A roof bracket assembly comprising:

a bracket comprising a coupling portion, a support portion and a retaining portion, said coupling portion being spaced from said support portion, said coupling portion of said bracket being configured for positioning proximate a soffit of a roof such that said support portion extends upwardly from an eave of said roof, said bracket being one of a plurality of brackets, said plurality of said brackets being configured for being evenly spaced along a selected length of said eave of said roof;

a lip extending laterally away from a top of said coupling portion of said bracket, said lip being configured for positioning proximate said soffit of said roof such that a top surface of said lip abuts a bottom surface of said soffit;

a pair of fastener apertures extending through said lip;

a pair of fasteners extending through said each of said fastener apertures in said lip and being configured to engage said soffit, wherein said coupling portion is configured to be coupled to said soffit;

said retaining portion being positioned between said coupling portion and said support portion, a front edge of said retaining portion extending upwardly at a right angle from an inner end of said coupling portion, wherein said front edge of said retaining portion is configured to abut a front side of a facia on said roof when said lip is positioned proximate said soffit;

a tab extending laterally away from each of an associated one of said retaining portions proximate said front edge of said associated one of said retaining portions;

a fastener aperture extending through each of said tabs;

a fastener extending through said fastener aperture in each of said tabs and being configured to engage said facia, wherein said retaining portion is configured to be coupled to said facia;

a fastener aperture extending through a top end of said support portion;

a fastener extending through said fastener aperture in said support portion and being configured to engage a support member after said coupling portion is coupled to said soffit, wherein said support member is configured to be coupled to and retained on said support portion, wherein said support member is configured to be coupled to said roof; and a groove extending downwardly into a top of said coupling portion, said groove being configured for receiving a bottom edge of said facia, a first end of said groove being coupled to said retaining portion.

7. A method of retrofitting a support member to a roof, the steps of the method comprising:

providing a plurality of brackets and a plurality of support members, each of said brackets comprising a coupling portion, a support portion and a retaining portion, each of said brackets being configured to be coupled to and evenly spaced along a selected length of an eave of a roof;

positioning said coupling portion of each of said brackets proximate a soffit of said roof such that said support portion of each of said brackets extends upwardly from said eave of said roof;

positioning said retaining portion of each of said brackets such that a front edge of said retaining portion abuts a front side of a facia on said roof;

coupling said coupling portion of each of said brackets to said soffit;

coupling said retaining portion of each of said brackets to said facia;

positioning an end of each of said support members proximate said support portion of each of said brackets; and coupling said end of each of said support members to said support portion of each of said brackets.

8. A roof bracket assembly comprising:

a roof having an eave, a soffit, and a facia;

a plurality of brackets, each of said brackets comprising a coupling portion, a support portion, and a retaining portion, each of said brackets being evenly spaced along said eave of said roof, said coupling portion being positioned proximate said soffit of said roof such that said support portion of each of said brackets extends upwardly from said eave of said roof, said retaining portion of each of said brackets being positioned such that a front edge of said retaining portion abuts a front side of said facia on said roof, said coupling portion of each of said brackets being coupled to said soffit, said retaining portion of each of said brackets being coupled to said facia; and a plurality of support members, an end of each of said support members being positioned proximate said support portion of each of said brackets, said end of each of said support members being coupled to said support portion of each of said brackets.

* * * * *